US012331952B2

(12) United States Patent
Morrow et al.

(10) Patent No.: US 12,331,952 B2
(45) Date of Patent: Jun. 17, 2025

(54) AIR DAM FOR CONDENSATE DRAIN PAN

(71) Applicant: Johnson Controls Tyco IP Holdings LLP, Milwaukee, WI (US)

(72) Inventors: Cole Brennan Morrow, Derby, KS (US); Xianjin Cheng, Andover, KS (US); Johnny Huang, Wichita, KS (US); Stephen C. Szczepanski, Wichita, KS (US)

(73) Assignee: JOHNSON CONTROLS LIGHT COMMERCIAL IP GMBH, Neuhausen am Rheinfall (CH)

( * ) Notice: Subject to any disclaimer, the term of this patent is extended or adjusted under 35 U.S.C. 154(b) by 21 days.

(21) Appl. No.: 17/733,569

(22) Filed: Apr. 29, 2022

(65) Prior Publication Data

US 2022/0349618 A1 Nov. 3, 2022

Related U.S. Application Data

(60) Provisional application No. 63/182,566, filed on Apr. 30, 2021.

(51) Int. Cl.
*F24F 13/08* (2006.01)
*F24F 13/22* (2006.01)

(52) U.S. Cl.
CPC ..... *F24F 13/222* (2013.01); *F24F 13/08* (2013.01)

(58) Field of Classification Search
CPC ..... F24F 13/222; F24F 13/08; F24F 13/22; F28F 17/005; F25D 21/14
See application file for complete search history.

(56) References Cited

U.S. PATENT DOCUMENTS

| | | | | |
|---|---|---|---|---|
| 2,218,208 | A * | 10/1940 | Hopkins | F25D 21/14 62/418 |
| 8,220,282 | B2 | 7/2012 | Hast et al. | |
| D761,943 | S | 7/2016 | Yamamoto et al. | |
| 2019/0226775 | A1* | 7/2019 | Lorang | F24F 1/02 |
| 2022/0003463 | A1* | 1/2022 | Takegami | F25B 1/10 |
| 2022/0073385 | A1* | 3/2022 | Herbkersman | C02F 1/50 |

FOREIGN PATENT DOCUMENTS

| | | | | |
|---|---|---|---|---|
| WO | WO-2007012161 | A2 * | 2/2007 | F24F 1/00 |
| WO | WO-2017082481 | A1 * | 5/2017 | F02B 29/04 |

OTHER PUBLICATIONS

WO-2017082481-A1 English Translation (Year: 2017).*

* cited by examiner

*Primary Examiner* — David J Teitelbaum
*Assistant Examiner* — Devon Moore
(74) *Attorney, Agent, or Firm* — Fletcher Yoder, PC

(57) ABSTRACT

A heating, ventilation, and air conditioning (HVAC) system includes a condensate drain pan configured to be positioned beneath a heat exchanger of the HVAC system, relative to gravity, and configured to collect condensate formed via operation of the heat exchanger. The condensate drain pan comprises a drain surface, a plurality of walls extending from the drain surface to form a receptacle configured to collect the condensate, and a drain outlet formed in a wall of the plurality of walls. The condensate drain pan further comprises an air dam comprising a plurality of baffles, wherein a baffle of the plurality of baffles extends from the wall of the plurality of walls. The air dam is configured to re-direct an air flow flowing within the condensate drain pan away from the drain outlet.

20 Claims, 8 Drawing Sheets

AIR DAM FOR CONDENSATE DRAIN PAN

CROSS-REFERENCE TO RELATED APPLICATION

This application claims priority from and the benefit of U.S. Provisional Application No. 63/182,566, entitled "AIR DAM FOR CONDENSATE PAN," filed Apr. 30, 2021, which is hereby incorporated by reference in its entirety for all purposes.

BACKGROUND

This section is intended to introduce the reader to various aspects of art that may be related to various aspects of the present disclosure and are described below. This discussion is believed to be helpful in providing the reader with background information to facilitate a better understanding of the various aspects of the present disclosure. Accordingly, it should be noted that these statements are to be read in this light, and not as admissions of prior art.

Heating, ventilation, and/or air conditioning (HVAC) systems are utilized in residential, commercial, and industrial environments to control environmental properties, such as temperature and humidity, for occupants of the respective environments. For example, an HVAC system may include a blower configured to generate an air flow and one or more heat exchangers configured to condition the air flow. For example, the heat exchangers may be configured to place the air flow in a heat exchange relationship with a refrigerant of a vapor compression circuit, configured to place the air flow in a heat exchange relationship with combustion products, or both. In general, the heat exchange relationship may cause a change in pressures and/or temperatures of the air flow, the refrigerant, the combustion products, or any combination thereof. In some instances, heat transfer between the air flow and one or more of the heat exchangers may cause vapor and/or liquid (e.g., moisture) within the air flow to condense and form condensate in, on, and/or near the heat exchanger.

In traditional systems, a condensate drain pan may be positioned beneath a heat exchanger of the HVAC system to collect condensate formed in, on, or near the heat exchanger. When the system is operating in high humidity conditions and/or at high air flow rates, the rate of condensate generation may be increased. As the condensate is collected and directed towards a drain outlet of the condensate drain pan, the high velocity of the air flow may disrupt the drainage of condensate from the condensate drain pan. As a result, condensate may accumulate in the drain pan and the air flow may carry or blow the collected condensate (e.g., condensate carryover) beyond or external to the drain pan. Unfortunately, traditional condensate collection and drainage systems may inadequately mitigate condensate carryover and/or may provide inadequate drainage of condensate within the drain pan. Further, traditional systems may utilize reduced air velocities to reduce condensate carryover, which may limit operation and/or reduce efficiency of the HVAC systems.

SUMMARY

A summary of certain embodiments disclosed herein is set forth below. It should be noted that these aspects are presented merely to provide the reader with a brief summary of these certain embodiments and that these aspects are not intended to limit the scope of this disclosure. Indeed, this disclosure may encompass a variety of aspects that may not be set forth below.

In an embodiment, a heating, ventilation, and air conditioning (HVAC) system includes a condensate drain pan configured to be positioned beneath a heat exchanger of the HVAC system, relative to gravity, and configured to collect condensate formed via operation of the heat exchanger. The condensate drain pan comprises a drain surface, a plurality of walls extending from the drain surface to form a receptacle configured to collect the condensate, and a drain outlet formed in a wall of the plurality of walls. The condensate drain pan further comprises an air dam comprising a plurality of baffles, wherein a baffle of the plurality of baffles extends from the wall of the plurality of walls. The air am is configured to re-direct an air flow flowing within the condensate drain pan away from the drain outlet.

In another embodiment, a heating, ventilation, and air conditioning (HVAC) system includes a heat exchanger configured to condition an air flow directed across the heat exchanger and a condensate drain pan positioned beneath the heat exchanger and configured to collect condensate formed via heat exchange between the air flow and the heat exchanger. The condensate drain pan comprises a drain surface configured to collect the condensate, a plurality of walls extending from the drain surface and defining an outer perimeter of the drain surface, and a drain outlet formed within a wall of the plurality of walls and configured to discharge the condensate from the condensate drain pan. The condensate drain pan also comprises an air dam extending from the drain surface within the outer perimeter of the drain surface. The air dam includes a plurality of baffles configured to re-direct the air flow away from the drain outlet, and at least one baffle of the plurality of baffles extends from the wall.

In another embodiment, a condensate drain pan for a heating, ventilation, and air conditioning (HVAC) system includes a drain surface configured to collect condensate formed via operation of a heat exchanger of the HVAC system, and the drain surface is configured to be positioned beneath the heat exchanger relative to gravity. The condensate drain pan may also include a plurality of walls extending from the drain surface and defining an outer perimeter of the condensate drain pan, and a drain outlet formed within a wall of the plurality of walls and configured to discharge the condensate from the condensate drain pan. The condensate drain pan may also include a plurality of baffles extending from the drain surface and disposed upstream of the drain outlet relative to a direction of an air flow along the condensate drain pan and across the heat exchanger. The plurality of baffles comprises a first baffle extending from the wall and a second baffle offset from the wall.

BRIEF DESCRIPTION OF DRAWINGS

Various aspects of this disclosure may be better understood upon reading the following detailed description and upon reference to the drawings in which.

DETAILED DESCRIPTION

Figure 1:
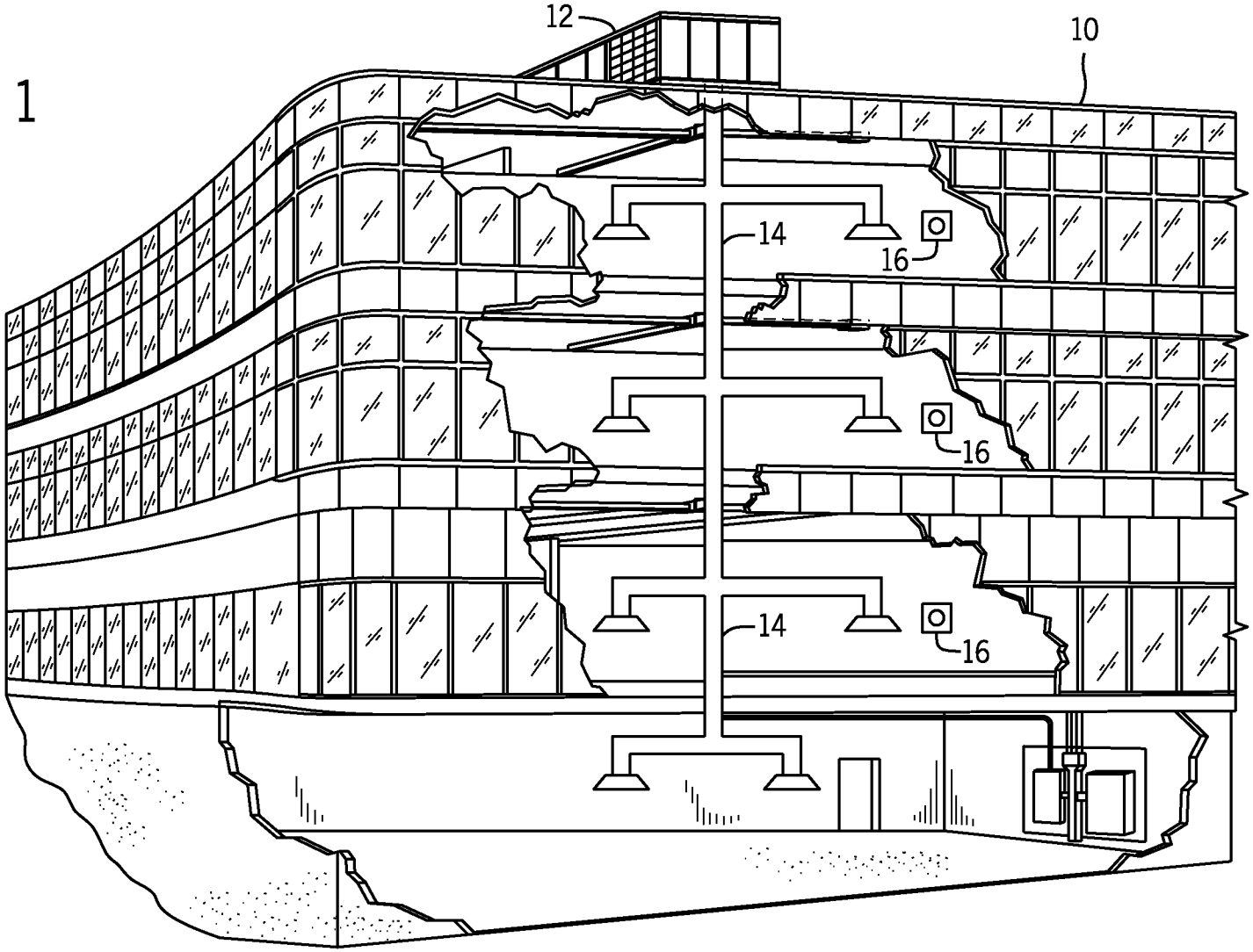
FIG. 1 is a perspective view of a building having an embodiment of a heating, ventilation, and/or air conditioning (HVAC) system for environmental management that may employ one or more HVAC units, in accordance with an aspect of the present disclosure.

The present disclosure relates generally to a heating, ventilation, and air conditioning (HVAC) system, and more particularly, to a condensate drain pan with an air dam (e.g., barrier) configured to reduce or impede adverse impact of an air flow on condensate collection and drainage.

One or more specific embodiments will be described below. In an effort to provide a concise description of these embodiments, not all features of an actual implementation are described in the specification. It should be noted that in the development of any such actual implementation, as in any engineering or design project, numerous implementation-specific decisions must be made to achieve the developers' specific goals, such as compliance with system-related and business-related constraints, which may vary from one implementation to another. Moreover, it should be noted that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be noted that references to "one embodiment" or "an embodiment" of the present disclosure are not intended to be interpreted as excluding the existence of additional embodiments that also incorporate the recited features.

The present disclosure is directed to a heating, ventilation, and/or air conditioning (HVAC) system. The HVAC system may include a vapor compression circuit that circulates a refrigerant for conditioning a supply air flow, a combustion cycle that circulates combustion products for conditioning the supply air flow, or a combination thereof. For example, the vapor compression circuit may include at least one heat exchanger configured to receive the refrigerant. Further, at least one blower may be employed and configured to direct the supply air flow across the at least one heat exchanger. The supply air flow may then be directed into a space to condition the space. In some embodiments, the vapor compression circuit may be a heat pump that provides, via the supply air flow, both heating and cooling to the conditioned space. For example, a refrigerant flow through the vapor compression circuit may be reversed to change the HVAC system from a heating mode to a cooling mode and vice versa. Accordingly, in a first operating mode (e.g., heating mode) of the vapor compression circuit, a first heat exchanger may act as a condenser and a second heat exchanger may act as an evaporator, whereas in a second operating mode (e.g., cooling mode) of the vapor compression circuit, the first heat exchanger may act as an evaporator and the second heat exchanger may act as a condenser.

Additionally or alternatively, the HVAC system may include a combustion cycle employing a furnace (e.g., a condensing furnace) configured to provide a heated supply air flow to the conditioned space. For example, the furnace may include a heat exchanger having tubing that is configured to receive relatively hot combustion products (e.g., ignited flue gas). The blower mentioned above and/or another blower may be configured to direct the supply air flow across the tubing, thereby placing the supply air flow in a heat exchange relationship with the relatively hot combustion products to heat the supply air flow. In other embodiments, the HVAC system may include an electric furnace having one or more heating elements configured to heat the supply air flow. Thereafter, the heated supply air flow may be directed into the conditioned space.

In some circumstances, condensate may form in, on, or near various of the above-described heat exchangers during operation of the HVAC system. For example, the blower may generate an air flow that is cooled and dehumidified as it passes across a heat exchanger of the vapor compression circuit, thereby causing moisture contained within the air flow to condense. In traditional systems, condensate management systems are configured to remove at least some of the condensate generated in order to drain the condensate to another location. Unfortunately, traditional systems are susceptible to inefficient condensate drainage, which may be caused or augmented by the air flow directed across the heat exchanger. For example, as a velocity or flow rate of air flow increases, condensate flowing towards a drain outlet of the condensate drain pan (e.g., via gravity) may be forced or directed away from the drain outlet by the air flow, thereby hindering the condensate from draining properly. As a result, the condensate may accumulate in the condensate drain pan and may be carried or blown off of the condensate drain pan (e.g., condensate carryover, condensate blowoff) by the air flow at increased velocities. It should be noted that in the context of the present application, "condensate carryover" refers to condensate particles that have accumulated and are blown or carried off or out of the condensate drain pan by an air flow directed across the condensate drain pan before the condensate particles are drained from the condensate drain pan (e.g., via a drain outlet of the drain pan). For example, condensate particles carried outside of the condensate drain pan may collect on other components of the HVAC system which may limit performance, increase a potential for wear and degradation on HVAC system components, and/or cause other undesirable effects. To mitigate the potential for condensate carryover, traditional systems may operate to reduce a flow rate of the air flow, which may limit performance and/or efficiency of the systems.

It is now recognized that there is a need for condensate collection and drainage systems that mitigate the inefficiencies of traditional systems discussed above. Accordingly, the present disclosure is directed to an improved condensate collection and drainage system configured to reduce or impede disruption of the flow of condensate towards a drain outlet of the condensate drain pan that may otherwise be caused by an air flow directed across and/or over the condensate drain pan. Thus, present embodiments improve condensate drainage and limit or reduce the potential for condensate carryover. Further, limiting or reducing the potential for condensate carryover may reduce potential wear and/or degradation of the HVAC system and may also enable operation of the HVAC system at enhanced (e.g., increased) air flow rates. For example, a condensate drain pan may be positioned beneath a heat exchanger of the HVAC system relative to gravity and may include an air dam (e.g., barrier) formed from one or more baffles. The air dam may be configured to re-direct an air flow directed across the condensate pan (e.g., away from a drain outlet of the condensate drain pan) that may otherwise disrupt or interfere with the flow of liquid condensate directed towards the drain outlet, thereby enhancing drainage of the condensate from the condensate drain pan. In this way, the air dam may reduce an amount of accumulated condensate within the condensate drain pan and provide protection to additional components of the HVAC system and/or an environment including the HVAC system that would otherwise be susceptible to condensate carryover in traditional systems. Further, the presently disclosed condensate drain pan and air dam may reduce a likelihood of wear and degradation to the HVAC system, components thereof (e.g., electronics), and/or an area surrounding the HVAC system that may be caused by water (e.g., liquid, moisture) presence during operation of the HVAC system.

Turning now to the drawings, FIG. 1 illustrates an embodiment of a heating, ventilation, and/or air conditioning (HVAC) system for environmental management that may employ one or more HVAC units. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or one or more zones (101, 102, 103) of the building 10 and each zone may further comprise one or more outdoor air hoods equipped with filters. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
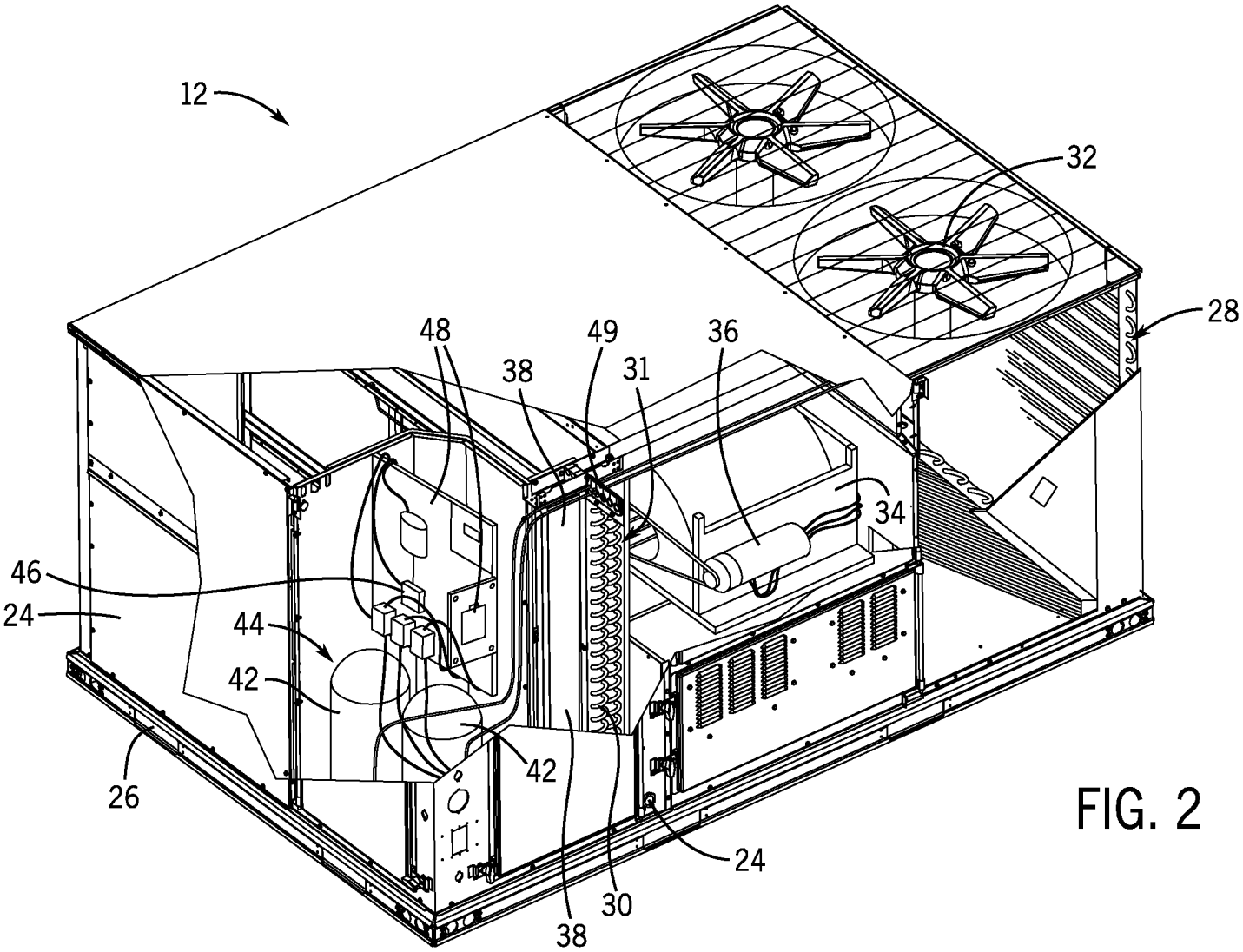
FIG. 2 is a perspective view of an embodiment of a packaged HVAC unit that may be used in the HVAC system of FIG. 1, in accordance with an aspect of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit onto "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant, such as R-410A, through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the HVAC unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. Additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
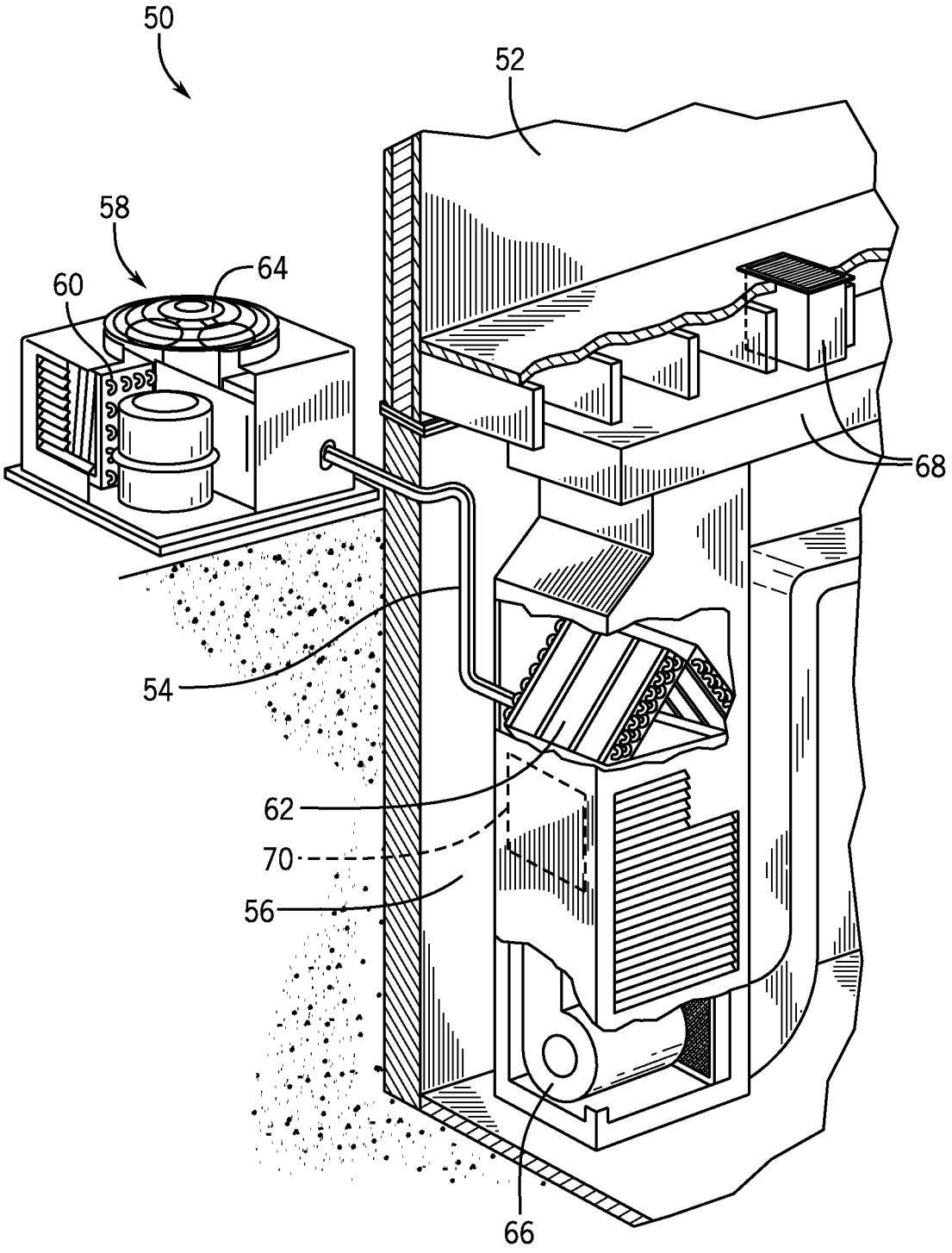
FIG. 3 is a cutaway perspective view of an embodiment of a residential, split HVAC system, in accordance with an aspect of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or the set point plus a small amount, the residential heating and cooling system 50 may become operative to refrigerate additional air for circulation through the residence 52. When the temperature reaches the set point, or the set point minus a small amount, the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over the outdoor heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace system 70 where it is mixed with air and combusted to form combustion products. The combustion products may pass through tubes or piping in a heat exchanger, separate from heat exchanger 62, such that air directed by the blower or fan 66 passes over the tubes or pipes and extracts heat from the combustion products. The heated air may then be routed from the furnace system 70 to the ductwork 68 for heating the residence 52.

Figure 4:
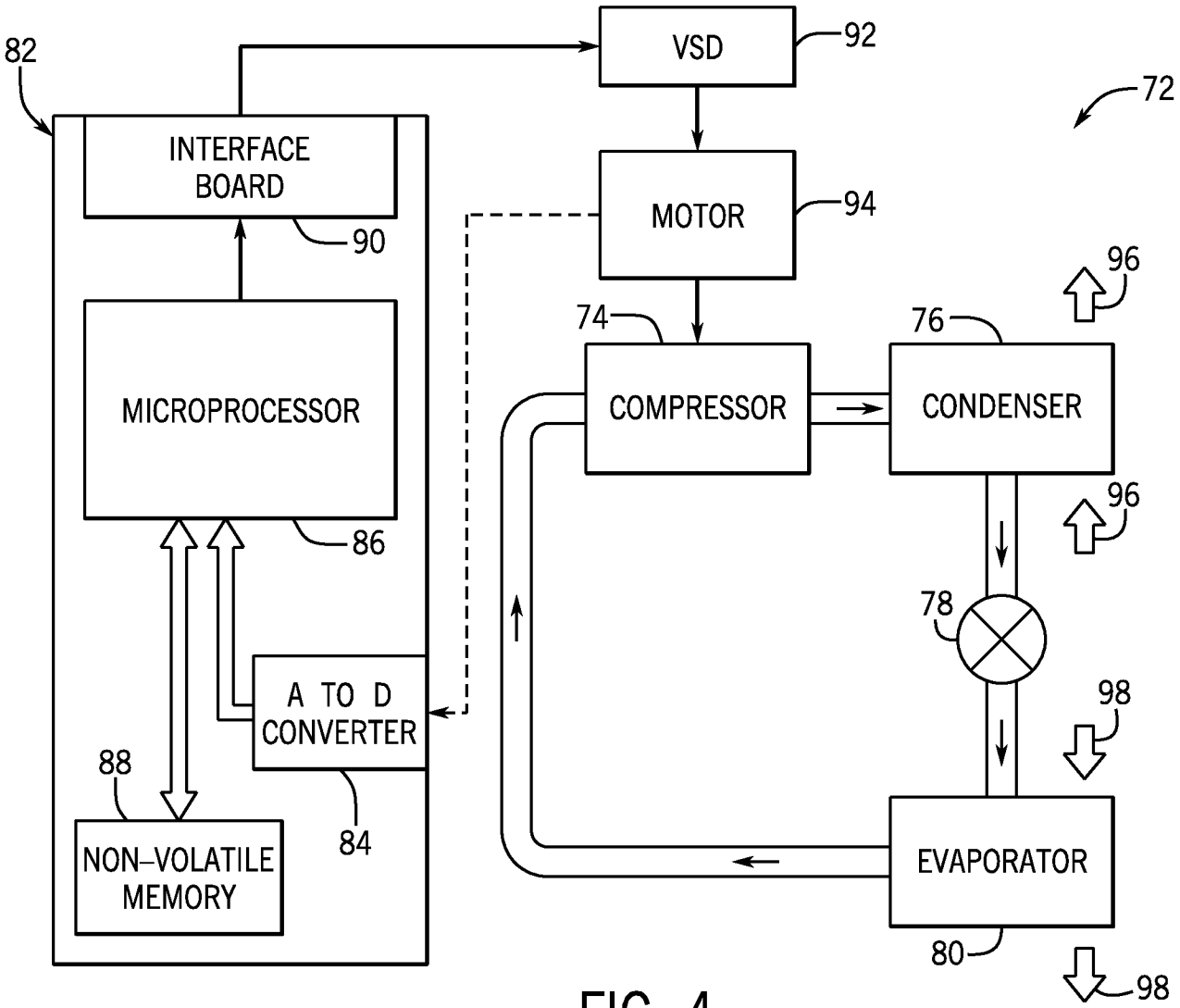
FIG. 4 is a schematic illustration of an embodiment of a vapor compression system that can be used in any of the systems of FIGS. 1-3, in accordance with an aspect of the present disclosure.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 80 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

It should be appreciated that any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

Further, one of ordinary skill in the art will appreciate that any of the systems illustrated in FIGS. 1-4 may generate condensate as an air flow is directed across a heat exchanger (e.g., heat exchanger 30 of the HVAC unit 12 in FIG. 2) by a fan or blower. For example, as the air flow loses heat to the heat exchanger, vapor or liquid within the air flow may condense to form condensate (e.g., on or near the heat exchanger), which may be collected in a condensate drain pan. The presently disclosed techniques may be utilized with any of the systems described above, as well as other HVAC systems, to re-direct the air flow directed across the condensate drain pan, such that drainage of the condensate within the condensate drain pan is improved and the likelihood or potential for condensate carryover via the air flow is reduced.

In accordance with the present disclosure, a condensate drain pan may be utilized to collect and drain the above-described liquid condensate. The condensate drain pan may be positioned beneath a heat exchanger relative to gravity to collect liquid condensate that falls from the heat exchanger and/or from an air flow directed across the heat exchanger via gravity. For example, when environmental conditions (e.g., humidity levels and temperatures), such as conditions within a space serviced by the HVAC system, are above a threshold value (e.g., greater than 60%, 70%, 80% humidity and/or greater than 80° F., 90° F., 100° F.), the HVAC system may operate to increase a speed of a blower or fan in order to meet or satisfy a demand (e.g., cooling demand) of the space. As the speed of the blower or fan increases, the flow rate of the air flow induced across the condensate drain pan (e.g., towards a drain outlet of the condensate drain pan) may also increase, which may cause condensate within the condensate drain pan and flowing towards the drain outlet to be directed away from the drain outlet and to accumulate in the condensate drain pan. That is, the air flow directed across the condensate drain pan (e.g., and adjacent the drain outlet) may create a pocket of air at an opening of the drain outlet, thereby limiting the ability of condensate to drain out of the condensate drain pan via the drain outlet. In turn, as condensate accumulates in the condensate drain pan and is blocked (e.g., obstructed, impeded, disrupted) from flowing towards the outlet by the air flow, accumulated condensate particles may be carried or blown (e.g., condensate carryover) off and/or out of the condensate drain pan. By installing the disclosed condensate drain pan including an air dam, liquid condensate drainage may be improved, thereby mitigating the potential of undesirable effects traditionally caused by liquid condensate that accumulates and is then blow or carried out of the condensate drain pan by the air flow (e.g., condensate carryover). Further, the condensate drain pan disclosed herein may enable an enhanced air flow via increased blower speeds.

Figure 5:
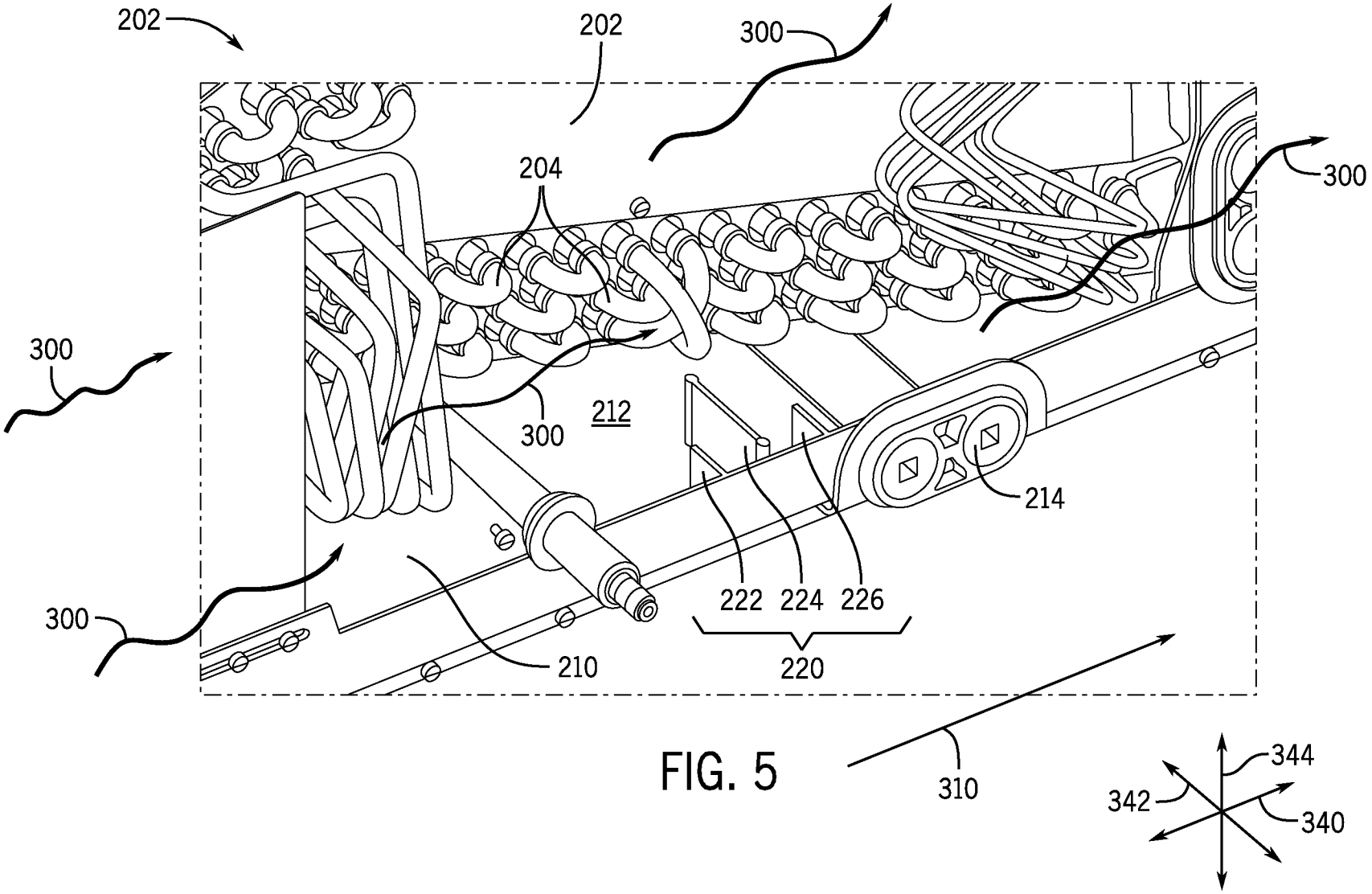
FIG. 5 is an expanded perspective view of an embodiment of an HVAC system including a condensate drain system having an air dam, in accordance with an aspect of the present disclosure.

With this in mind, FIG. 5 is a perspective view of an embodiment of a system 200 (e.g., HVAC system, condensate drain system, enhanced air flow system, air dam system) configured to provide improved drainage of condensate (e.g., condensate particles, liquid condensate) and enable an enhanced (e.g., increased) air flow in an HVAC system. The illustrated embodiment is intended to focus on certain features that enable the functionalities and benefits of the presently disclosed techniques, but it should be appreciated that the system 200 may include additional features, such as components described above with reference to FIGS. 1-4. The system 200 includes a heat exchanger 202 (e.g., an evaporator) with a number of heat exchange tubes 204 configured to place an air flow 300 in a heat exchange relationship with a refrigerant circulated through the heat exchange tubes 204, as similarly described above. It should be noted that the illustrated embodiment depicts the heat exchanger 202 in a horizontal right configuration. That is, the air flow 300 is induced by one or more blowers or fans (not shown) across the heat exchanger 202 in a direction 310 (e.g., horizontal direction, a left to right direction across the heat exchanger 202) along a longitudinal axis 340 of the system 200. In some embodiments, other configurations (e.g., horizontal left, vertical) may include the features described below. A condensate drain pan 210 may be positioned below the heat exchanger 202 and the heat exchange tubes 204 relative to gravity (e.g., relative to vertical axis 344) and may be configured to collect and drain condensate that may be formed and/or accumulated as the air flow 300 is directed across the heat exchanger 202. The condensate drain pan 210 may include a drain surface 212 configured to direct collected condensate towards a drain outlet 214 of the condensate drain pan 210. The drain outlet 214 may then remove the collected condensate from the condensate drain pan 210 and direct the condensate to another location (e.g., via a conduit fluidly coupled to the drain outlet 214). As illustrated, the condensate drain pan 210 may further include an air dam 220 (e.g., barrier) having a first baffle 222, a second baffle 224, and a third baffle 226. The air dam 220 may be positioned upstream of the drain outlet 214 relative to the longitudinal axis 340 and/or the direction 310 of the air flow 300.

During an operating mode (e.g., cooling mode) of the system 200, a portion of the air flow 300 directed across the heat exchanger 202 may flow towards and/or adjacent to the drain outlet 214, which may force or direct condensate (e.g., condensate particles) within the condensate drain pan 210 away from the drain outlet 214, as described above. By positioning the air dam 220 upstream of the drain outlet 214 relative to the direction 310 of the air flow 300, the air dam 220 may serve as a protective barrier that re-directs the air flow 300 away from the drain outlet 214. Thus, the air dam 220 may block or impede the air flow 300 from directing liquid condensate away from the drain outlet 214. In some embodiments, the condensate drain pan 210 including the air dam 220 (e.g., including the air dam 220) may be a single piece (e.g., integrally formed) component configured to collect and drain condensate and also limit adverse effects on drainage of the condensate that may otherwise be caused by the air flow 300, as described in greater detail below.

Figure 6:
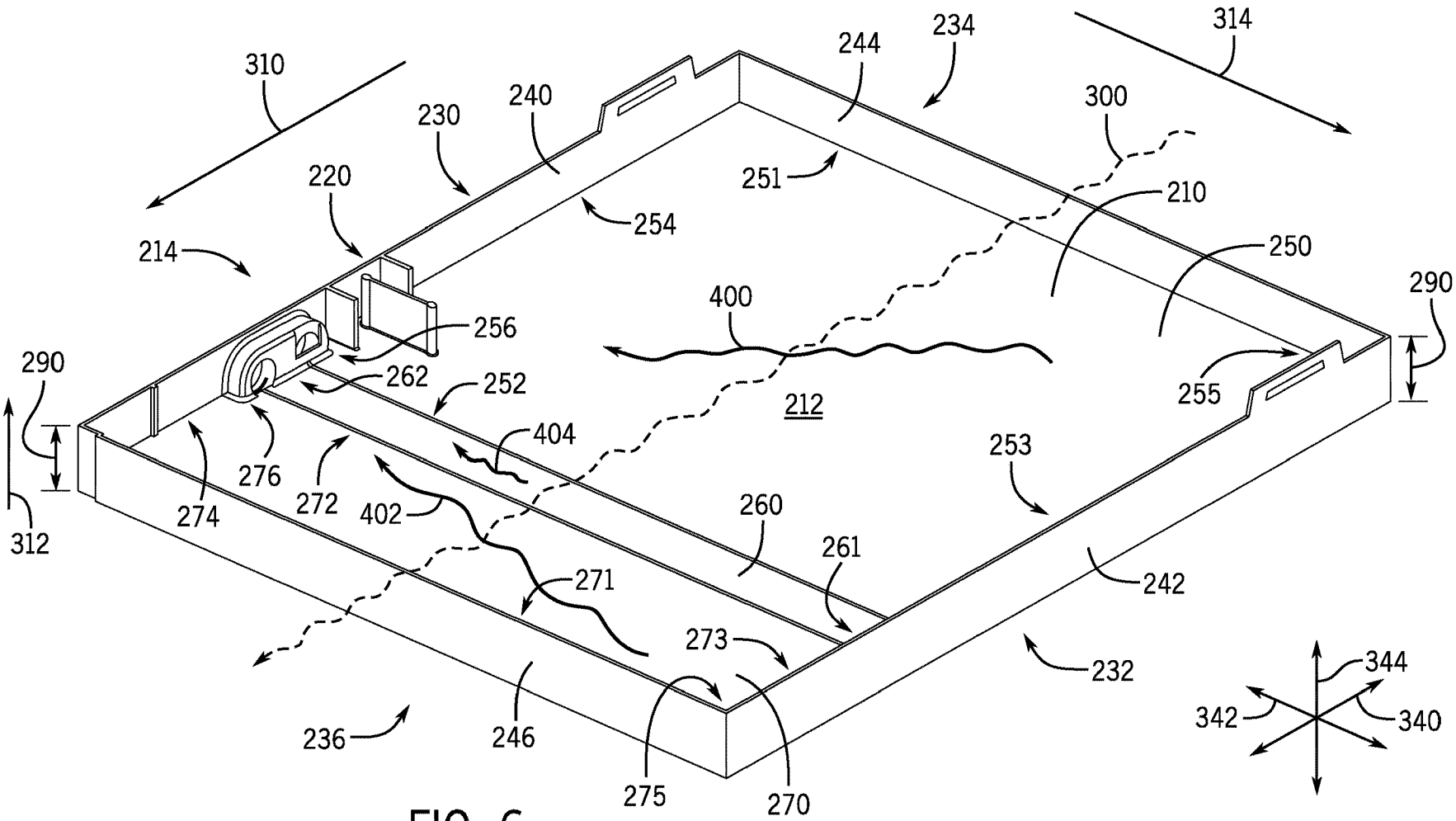
FIG. 6 is a perspective view of an embodiment of a condensate drain pan for an HVAC system, in accordance with an aspect of the present disclosure.

FIG. 6 is a perspective view of an embodiment of the condensate drain pan 210. The condensate drain pan 210 (e.g., condensate receptacle) may have a first side 230 having a wall 240 (e.g., first wall, first lip), a second side 232, opposite the first side 230, having a wall 242 (e.g., second wall, second lip), a third side 234 having a wall 244 (e.g., third wall, third lip), and a fourth side 236, opposite the third side 234, having a wall 246 (e.g., fourth wall, fourth lip). Each of the walls 240, 242, 244, 246 may extend a height 290 (e.g., dimension) from the drain surface 212 of the condensate drain pan 210 in a direction 312 (e.g., vertical direction) along the vertical axis 344 and may be configured to trap and contain condensate that falls from the heat exchanger 202 and/or the air flow 300 onto the drain surface 212 of the condensate drain pan 210. That is, each of the walls 240, 242, 244, 246 may lie in a respective plane that is substantially perpendicular (e.g., within 1%, 5%) to the drain surface 212. The walls 240, 242, 244, 246 may cooperatively define a perimeter (e.g., outer perimeter) of the drain surface 212. Collectively, the drain surface 212 and the walls 240, 242, 244, 246 may form a receptacle (e.g., condensate drain pan 210, basin, reservoir) configured to collect and remove liquid condensate via the drain outlet 214.

The drain surface 212 may include a first section 250, a second section 260, and a third section 270. Each of the sections 250, 260, 270 may be configured to direct condensate towards the drain outlet 214. For example, the first section 250 of the drain surface 212 may be positioned at an angle (e.g., first angle) relative to the longitudinal axis 340 and a lateral axis 342 (e.g., sloped, angled relative to a horizontal plane), such that condensate collected by or accumulated on the first section 250 may be directed in a direction 400 towards the second section 260 and towards the drain outlet 214. That is, a first side 251 of the first section 250 may be positioned higher along the vertical axis 344 relative to gravity than a second side 252 of the first section 250, such that condensate flows generally along the longitudinal axis 340 via gravity. Additionally or alternatively, a third side 253 of the first section 250 may be positioned higher along the vertical axis 344 relative to gravity than a fourth side 254 of the first section 250, such that condensate flows generally along the lateral axis 342 of the condensate drain pan 210 via gravity. Thus, in some embodiments, the first section 250 may have a compound slope (e.g., sloped in two or more directions). Accordingly, the first section 250 may have a first corner 255 corresponding to a relative high point (e.g., relative to the vertical axis 344) of the first section 250 and a second corner 256 corresponding to a relative low point (e.g., relative to the vertical axis 344) of the first section 250, thereby enabling flow of condensate collected by the first section 250 in the direction 400 towards the drain outlet 214.

Similarly, the third section 270 of the drain surface 212 may be positioned at an angle (e.g., second angle) relative the longitudinal axis 340 and the lateral axis 342 (e.g., sloped, angled relative to a horizontal plane), such that condensate collected by the third section 270 may be directed in a direction 402 towards the second section 260 and towards the drain outlet 214. That is, a first side 271 of the third section 270 may be positioned higher along the vertical axis 344 relative to gravity than a second side 272 of the third section 270, such that condensate flows generally along the longitudinal axis 340 via gravity. Additionally or alternatively, a third side 273 of the third section 270 may be positioned higher along the vertical axis 344 relative to gravity than a fourth side 274 of the third section 270, such that condensate flows generally along the lateral axis 342 of the condensate drain pan 210 via gravity. Thus, the third section 270 may also have a compound slope, in some embodiments. Accordingly, the third section 270 may have a first corner 275 corresponding to a relative high point (e.g., relative to the vertical axis 344) of the third section 270 and a second corner 276 corresponding to a relative low point (e.g., relative to the vertical axis 344) of the third section 270, thereby enabling flow of condensate collected by the third section 270 in the direction 402 towards the drain outlet 214.

Further still, the second section 260 may be positioned at an angle (e.g., third angle) relative to the lateral axis 342 (e.g., sloped, angled relative to a horizontal plane), such that condensate collected by the second section 260 may be directed in a direction 404 towards the drain outlet 214. That is, a first side 261 of the second section 260 corresponding to a relative high point of the second section 260 may be positioned higher along the vertical axis 344 relative to gravity than a second side 262 of the second section 260 corresponding to a relative low point of the second section 260, thereby enabling flow of condensate collected by the second section 260 in the direction 404 towards the drain outlet 214. As illustrated, the drain outlet 214 may be formed within the wall 240, and the air dam 220 may be positioned along the first side 230 of the condensate drain pan 210 upstream of the drain outlet 214 relative to the direction 310 of the air flow 300 along the longitudinal axis 340. In this way, drainage of condensate from the condensate drain pan 210 may be improved by re-directing the air flow 300 flowing towards the drain outlet 214, as described in greater detail below.

Figure 7:
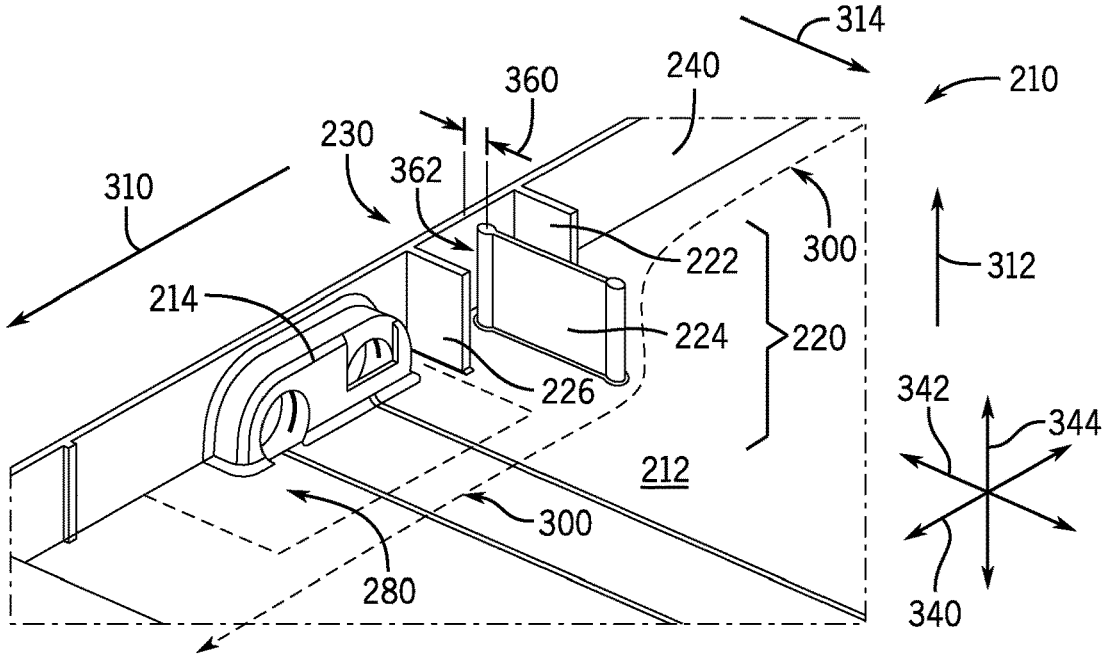
FIG. 7 is an expanded perspective view of an embodiment of an air dam for a condensate drain pan of an HVAC unit, in accordance with an aspect of the present disclosure.

FIG. 7 is an expanded perspective view of an embodiment of the condensate drain pan 210, illustrating the air dam 220 and the drain outlet 214. During an operating mode of the system 200 (e.g., HVAC system), liquid condensate may form as the air flow 300 is directed across a heat exchanger (e.g., heat exchanger 202 illustrated in FIG. 5). As described above, the drain surface 212 of the condensate drain pan 210 may be configured to direct the condensate that falls from the heat exchanger and/or from air flow 300 towards the drain outlet 214. The air dam 220 may be positioned along the wall 240 of the condensate drain pan 210 upstream of the drain outlet 214 relative to the direction 310 (e.g., horizontal direction) of the air flow 300. As illustrated, the air dam 220 may be configured to re-direct the air flow 300 as the air flow 300 approaches a drain area 280 proximate or adjacent the drain outlet 214. In other words, the air dam 220 may block, impede, or reduce flow of the air flow 300 to the drain area 280. As a result, an amount of condensate directed away from the area 280 by the air flow 300 may be limited or reduced by the air dam 220, thereby improving drainage of the condensate from the condensate drain pan 210 via the drain outlet 214.

As shown in FIG. 7, the air dam 220 may include the first baffle 222, the second baffle 224, and the third baffle 226. The wall 240 may extend in a direction along the longitudinal axis 340 that is generally parallel to the direction 310 of the airflow 300. Each of the first, second, and third baffles 222, 224, 226 may be positioned within respective planes that generally extend along the lateral axis 342 of the condensate drain pan 210 and at an angle substantially perpendicular (e.g., within 5%) to the direction 310 of the air flow 300, thereby obstructing or blocking the air flow 300 from reaching the drain area 280. For example, the first and the third baffles 222, 226 may extend from the wall 240 in a direction 314 (e.g., horizontal direction, lateral direction) along the lateral axis 342 and/or at an angle generally perpendicular relative to the direction 310 of the air flow 300. The first and third baffles 222, 226 may also extend from the drain surface 212 in the direction 312 (e.g., vertical direction) along the vertical axis 344. That is, the first and third baffles 222, 226 may be in contact with both the wall 240 and the drain surface 212 of the condensate drain pan 210. The second baffle 224 may extend along the lateral axis 342, but may be offset from the wall 240 along the lateral axis 342 by a distance 360. The second baffle 224 may also extend in the direction 312 (e.g., vertical direction) along the vertical axis 344 from the drain surface 212 of the condensate drain pan 210. Thus, the second baffle 224 may extend from the drain surface 212 of the condensate drain pan 210 but may not contact or be integrally formed with the wall 240, as described in greater detail below with reference to FIG. 8. By positioning the second baffle 224 offset from the wall 240 by the distance 360, condensate particles moving along the first side 230 of the condensate drain pan 210 towards the drain outlet 214 may still flow towards the drain outlet 214 while the air flow 300 flowing towards the drain outlet 214 is re-directed (e.g., disrupted, limited, blocked) away from the drain area 280, as described in greater detail below.

Figure 8:
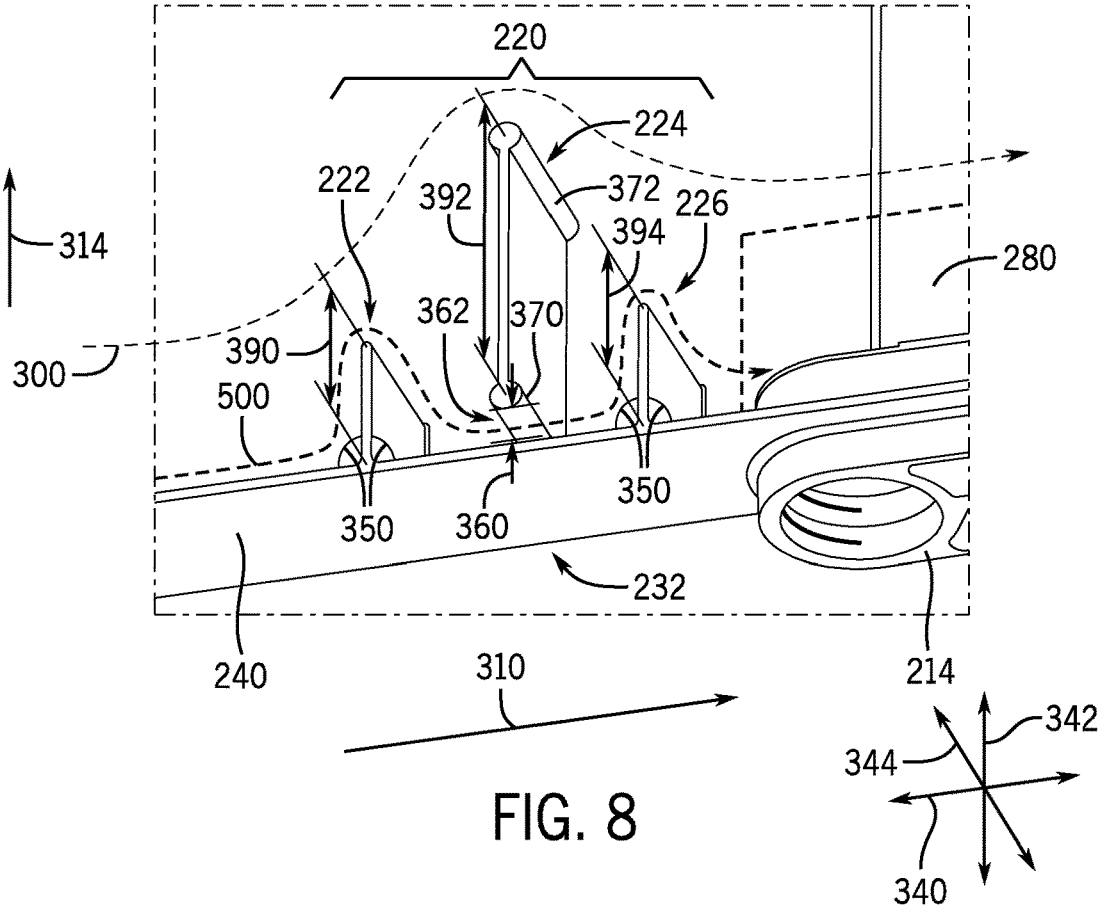
FIG. 8 is an expanded top perspective view of an embodiment of a condensate drain pan, illustrating a condensate flow path along the condensate drain pan, in accordance with an aspect of the present disclosure.

FIG. 8 is a top perspective view of an embodiment of the condensate drain pan 210 and the air dam 220, illustrating a flow path 500 (e.g., condensate flow path, liquid condensate flow path) of condensate particles along the first side 230 of the condensate drain pan 210. As condensate particles fall from the heat exchanger and/or the air flow 300 and are collected by the condensate drain pan 210, the condensate particles may be directed by the drain surface 212 of the condensate drain pan 210 towards the drain outlet 214. As described above, the air dam 220 may be positioned upstream of the drain outlet 214 relative to the direction 310 of the air flow 300 and may be configured to re-direct the air flow 300 flowing along the first side 230 of the condensate drain pan 210 away from the drain area 280, while still enabling condensate particles collected along the first side 230 of the condensate drain pan 210 to flow along the flow path 500 and be removed from the condensate drain pan 210 via the drain outlet 214. For example, the first baffle 222 and the third baffle 226 may each extend or protrude from the drain surface 212 in the direction 312 (shown in FIG. 7) along the vertical axis 344 of the condensate drain pan 210. Further, the first baffle 222 may extend from the wall 240 for a distance 390 (e.g., length, dimension) and the third baffle 226 may extend from the wall 240 for a distance 394 (e.g., length, dimension). Each of the first and third baffles 222, 226 may extend for the distance 390, 394, respectively, in the direction 314 (e.g., horizontal direction, lateral direction) along the lateral axis 342 and/or at an angle 350 that is substantially perpendicular (e.g., within 5%) to the wall 240 and/or to the direction 310 of the air flow 300. As noted above, the second baffle 224 may be offset from the wall 240 along the lateral axis 342 by a distance 360 (e.g., dimension) and may extend from the drain surface 212 of the condensate drain pan 210 in the direction 312 (e.g., vertical direction) along the vertical axis 344. Further, the second baffle 224 may also extend for a distance 392 (e.g., length, dimension) in the direction 314 (e.g., horizontal direction, lateral direction) along the lateral axis 342. By offsetting the second baffle 224 by the distance 360 from the wall 240, a channel 362 of the flow path 500 is formed between the second baffle 224 and the wall 240.

As condensate particles travel along the first side 230 of the condensate drain pan 210, the condensate particles may come into contact with the first baffle 222 and may be directed along the flow path 500 around the first baffle 222. After passing the first baffle 222, condensate particles may be directed (e.g., by gravity) towards the wall 240 and through the channel 362 due to the angle (e.g., slope) of the drain surface 212 described above. After passing through the channel 362 and past the second baffle 224, the condensate particles may then come into contact with the third baffle 226. Similar to the first baffle 222, the third baffle 226 may again direct the condensate particles away from the wall 240 along the flow path 500. Upon passing the third baffle 226, the condensate particles may be directed along the flow path 500 towards the drain area 280 (e.g., via gravity) to be removed from the condensate drain pan 210 via the drain outlet 214. It should be noted that each of the first, second, and third baffles 222, 224, 226 of the air dam 220 may each extend in a respective plane along the lateral axis 342 that is substantially perpendicular to the direction 310 of the air flow 300 (e.g., extend in a common direction crosswise to the direction 310 of the air flow 300). Thus, each of the first, second, and third baffles 222, 224, 226 may obstruct and re-direct the air flow 300 along the first side 230 of the condensate drain pan 210 away from the drain area 280, as described in greater detail below.

As discussed above, the first and third baffles 222, 226 may be structurally integrated with (e.g., integrally formed with) or coupled (e.g., via welding, 3-D printing, and the like) to the wall 240 and may extend or protrude from the wall 240 and the drain surface 212 of the condensate drain pan 210. The second baffle 224 may be offset from the wall 240 along the lateral axis 342 by the distance 360 and may be structurally integrated with or otherwise coupled to the drain surface 212 of the condensate drain pan 210. The second baffle 224 may also include a first structural support 370 and a second structural support 372 configured to improve the structural stability of the second baffle 224. That is, because the second baffle 224 is not coupled to the wall 240 of the condensate drain pan 210, the first structural support 370 and the second structural support 372 may be configured to provide structural rigidity to the second baffle 224, thereby enabling the second baffle 224 to withstand increased forces from the air flow 300 as the air flow 300 is re-directed around the air dam 220.

Figure 9:
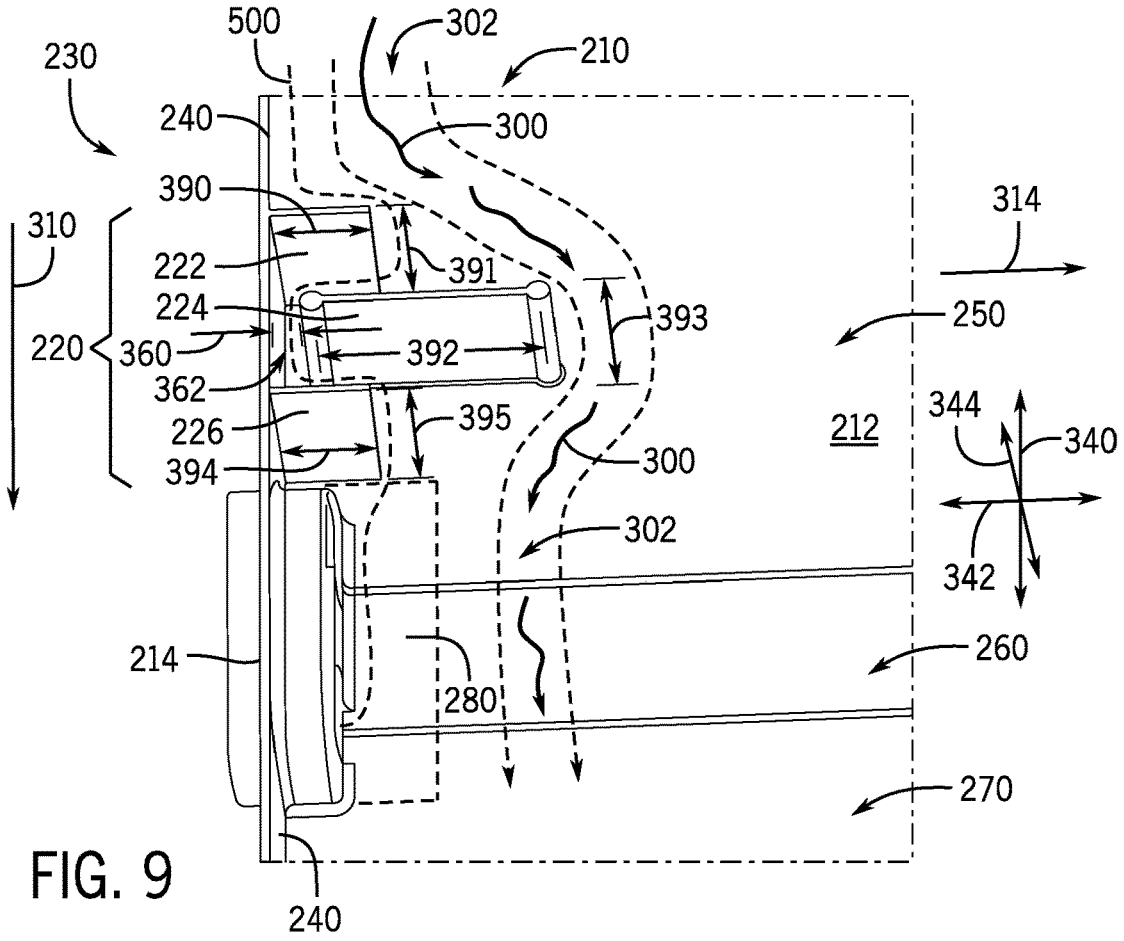
FIG. 9 is an expanded perspective view of an embodiment of a condensate drain pan, illustrating an air flow path along the condensate drain pan, in accordance with an aspect of the present disclosure.

FIG. 9 is a perspective view of an embodiment of the condensate drain pan 210 and the air dam 220, illustrating an air flow path 302 of the air flow 300 around the air dam 220. The first baffle 222 may extend the distance 390 (e.g., length, dimension) from the wall 240 in the direction 314 along the lateral axis 342 and may extend a distance 391 (e.g., height, dimension) from the drain surface 212 in the direction 312 along the vertical axis 344 (shown in FIG. 7). The third baffle 226 may extend the distance 394 (e.g., length, dimension) from the wall 240 in the direction 314 along the lateral axis 342 and may extend a distance 395 (e.g., height, dimension) from the drain surface 212 in the direction 312 along the vertical axis 344. The length 390 and the height 391 of the first baffle 222 and the length 394 and the height 395 of the third baffle 226 may be substantially similar, respectively (e.g., within 1%). As discussed above, the second baffle 224 may be offset from the wall 240 by the distance 360 and may extend a distance 393 (e.g., height, dimension) from the drain surface 212 in the direction 312 along the vertical axis 344. As noted above, the second baffle 224 may also extend for the distance 392 (e.g., length, dimension) along the lateral axis 342 of the condensate drain pan 210. The heights 391, 393, 395 of the first, second, and third baffles 222, 224, 226 may be substantially similar to one another and may also be substantially similar to the height 290 of the walls 240, 242, 244, 246 (illustrated in FIG. 6). The distance 392 of the second baffle 224 may be greater than the distances 390, 394 of the first and third baffles 222, 226, in some embodiments. However, regardless of the distance 392 of the second baffle 224 (e.g., same or different from the distances 290, 296 of the first and third baffles 222, 226, respectively), by offsetting the second baffle 224 from the wall 240 by the distance 360, the second baffle 224 may extend beyond the first and third baffles 222, 226 in the direction 314 along the lateral axis 342 such that the air flow 300 is re-directed away from the drain area 280.

During an operating mode, the flow path 302 of the air flow 300 may extend along the first side 230 of the condensate drain pan 210. As the air flow 300 travels along the first side 230, the air flow 300 may come into contact with the first baffle 222 of the air dam 220. As illustrated, upon approaching the first baffle 222, the air flow 300 may travel along a path of least resistance (e.g., along the flow path 302 and/or away from the wall 240 of the first side 230 of the condensate drain pan 210) and towards the second baffle 224. The second baffle 224 may be configured to further direct the air flow 300 away from the wall 240 of the first side 230 along the flow path 302. The third baffle 226 may be configured to still further re-direct the air flow 300 away from the wall 240 of the first side 230 of the condensate drain pan 210, such that the air flow 300 travels away from the drain area 280, thereby enabling the condensate particles to flow toward and/or reach the drain outlet 214 and be removed from the system (e.g., the condensate drain pan 210) with reduced resistance induced by the air flow 300. Further, while the illustrated embodiment depicts the flow path 302 extending around (e.g., laterally around relative to the lateral axis 342 and the longitudinal axis 340) the baffles 222, 224, 226, in some embodiments the baffles 222, 224, 226 may additionally or alternatively re-direct the air flow 300 along the vertical axis 344 over the air dam 220 (e.g., relative to gravity) to re-direct the air flow 300 away from the drain area 280. Thus, the baffles 222, 224, 226 may be configured to cooperatively re-direct the air flow 300 away from the wall 240, thereby blocking the air flow 300 from reaching, occupying, and/or obstructing the drain area 280 and reducing the potential for condensate carryover. It should be noted that the shape of the baffles 222, 224, 226 is not limited to the rectangular shape illustrated in FIG. 9, and may include different shapes (e.g., triangular, polygonal, trapezoidal) that may serve to block, impede, or obstruct the air flow 300 from reaching, occupying, and/or obstructing the drain area 280. Further, some embodiments may include fewer or more baffles as desired to perform the desired functions described above. Further still, magnitudes or values of the distances 390, 392, 394 of the baffles 222, 224, 226 may be selected based on various design considerations. For example, sizes and/or configurations of the baffles 222, 224, 226 may be selected to accommodate other structural features of the system, such as the heat exchanger 202 disposed above the condensate drain pan 210, while still enabling enhanced drainage of condensate from the system (e.g., the condensate drain pan 210).

Figure 10:
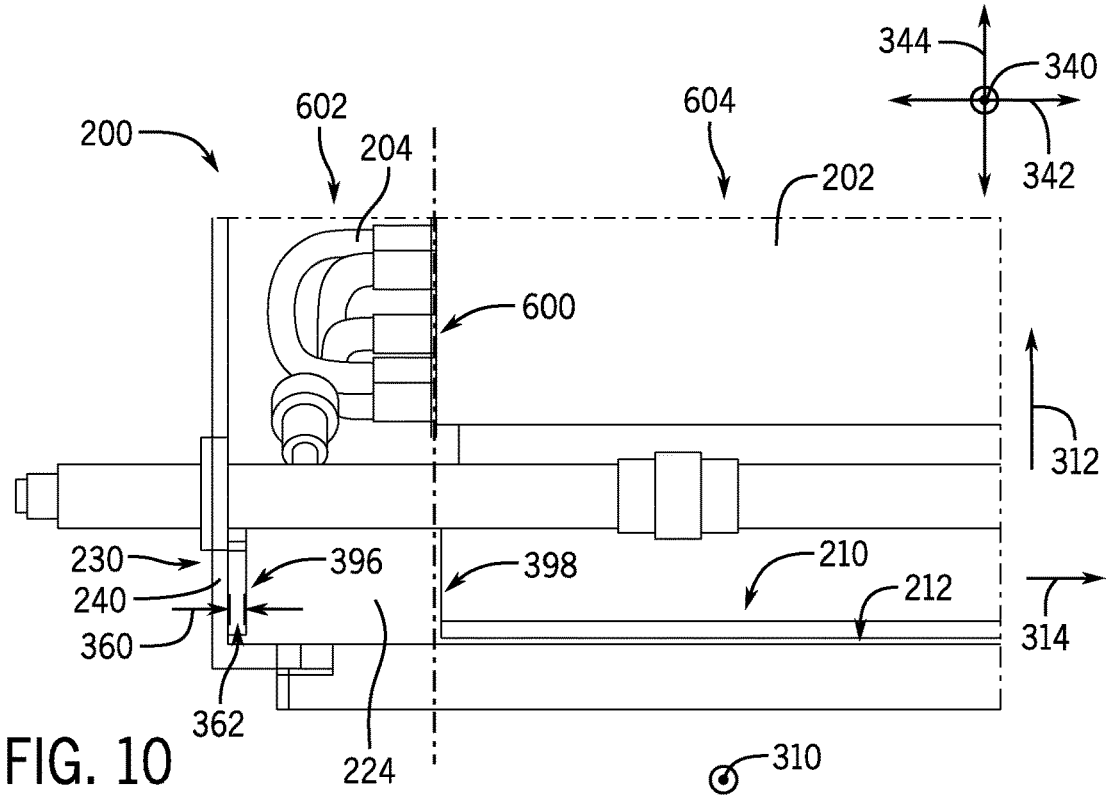
FIG. 10 is a cross-sectional axial view of an embodiment of a condensate drain pan in an HVAC system, in accordance with an aspect of the present disclosure.

FIG. 10 is a cross-sectional axial view of an embodiment of the condensate drain pan 210, illustrating the second baffle 224 of the air dam 220 and the heat exchanger 202 positioned above the condensate drain pan 210 relative to the vertical axis 344. As described above, the distance 392 of the second baffle 224 may be configured or selected based on other structural features or components that are incorporated with the system 200. For example, a first edge 396 of the second baffle 224 may be offset from the wall 240 by the distance 360, thereby creating the channel 362 illustrated in FIG. 8. A second edge 398 of the second baffle 224 may be positioned distal from the first edge 396 along the lateral axis 342 and relative to the wall 240 and may be configured to align with a joining plate 600 (e.g., tube sheet, end sheet) of the heat exchanger 202. The system 200 may also have a first section 602 (e.g., region, area, portion) extending between the wall 240 and the joining plate 600 and a second section 604 (e.g., region, area, portion) in which the heat exchanger 202 is disposed. By aligning the second edge 398 of the second baffle 224 with the joining plate 600 of the heat exchanger 202, the air flow 300 flowing through the first section 602 along the wall 240 of the first side 230 of the condensate drain pan 210 may be re-directed away from the drain area 280 by the second baffle 224, while the air flow 300 flowing through the second section 604 of the system 200 may flow across the heat exchanger 202 without interference from components of the condensate drain pan 210 (e.g., the second baffle 224 of the air dam 220). Thus, the air flow 300 may be desirably directed through the second section 604 and across the heat exchanger 202 without obstruction (e.g., impingement against the air dam 220) while also re-directing the air flow 300 flowing through the first section 602 away from the drain area 280, thereby improving the efficiency of the system 200.

Condensate collection and drainage systems, in accordance with the present disclosure, are configured to re-direct air flow flowing towards a drain outlet of a condensate drain pan, thereby improving the drainage of condensate from the drain pan. Further, by configuring the condensate drain pan with an air dam in the manner described above, the potential for condensate carryover may be limited or reduced. Thus, additional components of the HVAC system and/or an environment surrounding the HVAC system may be protected from exposure to condensate that may otherwise exist in traditional systems. That is, the presently disclosed condensate drain pan and air dam may reduce a likelihood of wear and degradation to the HVAC system, its components (e.g., electronics), and/or surrounding components (e.g., ductwork) that may be caused by moisture introduced via condensate carryover.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

While only certain features and embodiments of the disclosure have been illustrated and described, many modifications and changes may occur to those skilled in the art, such as variations in sizes, dimensions, structures, shapes and proportions of the various elements, values of parameters, including temperatures and pressures, mounting arrangements, use of materials, colors, orientations, and so forth without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure.

Furthermore, in an effort to provide a concise description of the exemplary embodiments, all features of an actual implementation may not have been described, such as those unrelated to the presently contemplated best mode of carrying out the disclosure, or those unrelated to enabling the claimed disclosure. It should be noted that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A heating, ventilation, and air conditioning (HVAC) system, comprising:

a condensate drain pan configured to be positioned beneath a heat exchanger of the HVAC system, relative to gravity, and configured to collect condensate formed via operation of the heat exchanger, wherein the condensate drain pan comprises:

a drain surface and a plurality of walls extending from the drain surface to form a receptacle configured to collect the condensate;

a drain outlet formed in a wall of the plurality of walls; and an air dam comprising a plurality of baffles, wherein the air dam is positioned upstream of the drain outlet relative to a direction of an air flow across the condensate drain pan and the heat exchanger, a first baffle of the plurality of baffles extends from the wall of the plurality of walls, a second baffle of the plurality of baffles extends from the drain surface and is spaced apart and separate from the wall of the plurality of walls, the air dam is configured to re-direct the air flow away from the drain outlet, and each baffle of the plurality of baffles extends in a common direction crosswise to the direction of the air flow.

2. The HVAC system of claim 1, wherein the second baffle of the plurality of baffles is positioned downstream of the first baffle of the plurality of baffles relative to the direction of the air flow.

3. The HVAC system of claim 1, wherein the plurality of baffles comprises a third baffle, and the third baffle is positioned downstream of the first baffle and the second baffle relative to the direction of the air flow.

4. The HVAC system of claim 1, wherein the condensate drain pan comprises a condensate flow path, the condensate flow path extends along the wall of the plurality of walls, and the condensate flow path is at least partially defined by a channel formed between the wall and the second baffle.

5. The HVAC system of claim 1, wherein the common direction is substantially perpendicular to the direction of the air flow.

6. The HVAC system of claim 3, wherein the third baffle extends from the wall of the plurality of walls.

7. The HVAC system of claim 3, wherein the first baffle extends in the common direction for a first distance, the second baffle extends in the common direction for a second distance, the third baffle extends in the common direction for a third distance, and the second distance is greater than the first distance and the third distance.

8. The HVAC system of claim 3, wherein each baffle of the plurality of baffles extends from the drain surface in a vertical direction, relative to gravity.

9. The HVAC system of claim 1, wherein each wall of the plurality of walls extends transversely from the drain surface.

10. The HVAC system of claim 1, wherein each wall of the plurality of walls extends from the drain surface in a vertical direction.

11. A heating, ventilation, and air conditioning (HVAC) system, comprising:

a heat exchanger configured to condition an air flow directed across the heat exchanger; and a condensate drain pan positioned beneath the heat exchanger, relative to gravity, and configured to collect condensate formed via heat exchange between the air flow and the heat exchanger, wherein the condensate drain pan comprises:

a drain surface configured to collect the condensate;

a plurality of walls extending from the drain surface and defining an outer perimeter of the drain surface;

a drain outlet formed within a wall of the plurality of walls and configured to discharge the condensate from the condensate drain pan; and an air dam disposed upstream of the drain outlet relative to a direction of the air flow along the condensate drain pan and across the heat exchanger, wherein the air dam extends from the drain surface within the outer perimeter of the drain surface and comprises a plurality of baffles configured to re-direct the air flow away from the drain outlet, one or more baffles of the plurality of baffles extend from the wall of the plurality of walls, at least one baffle of the plurality of baffles extends from the drain surface and is spaced apart and separate from the wall of the plurality of walls, and each baffle of the plurality of baffles extends in a common direction crosswise to the direction of the air flow.

12. The HVAC system of claim 11, wherein the plurality of baffles comprises:

a first baffle extending from the wall of the plurality of walls in the common direction crosswise to the direction of the air flow;

a second baffle spaced apart and separate from the wall of the plurality of walls and extending in the common direction, wherein the second baffle is positioned downstream of the first baffle relative to the direction of the air flow; and a third baffle extending from the wall of the plurality of walls in the common direction, wherein the third baffle is positioned downstream of the first baffle and the second baffle relative to the direction of the air flow.

13. The HVAC system of claim 11, wherein each baffle of the plurality of baffles extends from the drain surface by a respective height, and the respective height of each baffle of the plurality of baffles is the same.

14. The HVAC system of claim 12, wherein the second baffle is spaced apart and separated from the wall of the plurality of walls by a distance, the distance defines a channel between the wall of the plurality of walls and the second baffle, and the channel at least partially defines a condensate flow path of the condensate toward the drain outlet.

15. The HVAC system of claim 12, wherein a dimension of the second baffle along the common direction is greater than respective dimensions of the first baffle and the third baffle along the common direction.

16. A condensate drain pan for a heating, ventilation, and air conditioning (HVAC) system, comprising:

a drain surface configured to collect condensate formed via operation of a heat exchanger of the HVAC system, wherein the drain surface is configured to be positioned beneath the heat exchanger relative to gravity;

a plurality of walls extending from the drain surface and defining an outer perimeter of the condensate drain pan;

a drain outlet formed within a wall of the plurality of walls and configured to discharge the condensate from the condensate drain pan; and a plurality of baffles extending from the drain surface and disposed upstream of the drain outlet relative to a direction of an air flow along the condensate drain pan and across the heat exchanger, wherein the plurality of baffles comprises a first baffle extending from the wall of the plurality of walls and a second baffle extending from the drain surface and spaced apart from the wall of the plurality of walls to form a channel extending from the second baffle to the wall of the plurality of walls, and wherein each baffle of the plurality of baffles extends in a common direction crosswise to the direction of the air flow.

17. The condensate drain pan of claim 16, wherein the second baffle is disposed downstream of the first baffle relative to the direction of the air flow, and the plurality of baffles comprises a third baffle extending from the wall of the plurality of walls and disposed downstream of the first baffle and the second baffle relative to the direction of the air flow.

18. The condensate drain pan of claim 16, wherein the plurality of baffles define a condensate flow path of the condensate along the wall of the plurality of walls and toward the drain outlet, and the plurality of baffles is configured to re-direct the air flow away from the drain outlet.

19. The condensate drain pan of claim 16, wherein each baffle of the plurality of baffles extends from the drain surface in a vertical direction by a respective height, and the respective height of each baffle of the plurality of baffles is the same.

20. The condensate drain pan of claim 18, wherein the condensate flow path comprises the channel extending from the second baffle to the wall of the plurality of walls.

* * * * *